US011456124B2

(12) United States Patent
Kern et al.

(10) Patent No.: US 11,456,124 B2
(45) Date of Patent: Sep. 27, 2022

(54) ISOLATOR SWITCH AND DRIVE APPARATUS FOR AN ISOLATOR SWITCH

(71) Applicant: Siemens Energy Global GmbH & Co. KG, Munich (DE)

(72) Inventors: Johannes Kern, Berlin (DE); Gunnar Lutzke, Berlin (DE)

(73) Assignee: Siemens Energy Global GmbH & Co. KG, Munich (DE)

( * ) Notice: Subject to any disclaimer, the term of this patent is extended or adjusted under 35 U.S.C. 154(b) by 0 days.

(21) Appl. No.: 17/264,930

(22) PCT Filed: Jul. 2, 2019

(86) PCT No.: PCT/EP2019/067655
§ 371 (c)(1),
(2) Date: Feb. 1, 2021

(87) PCT Pub. No.: WO2020/025238
PCT Pub. Date: Feb. 6, 2020

(65) Prior Publication Data

US 2021/0319961 A1 Oct. 14, 2021

(30) Foreign Application Priority Data

Jul. 30, 2018 (DE) ..... 102018212648.8

(51) Int. Cl.

| | |
|---|---|
| ***H01H 3/40*** | (2006.01) |
| *H01H 3/26* | (2006.01) |
| *H01H 3/38* | (2006.01) |
| *H01H 3/32* | (2006.01) |

(52) U.S. Cl.
CPC ..... *H01H 3/40* (2013.01); *H01H 3/26* (2013.01); *H01H 3/38* (2013.01); *H01H 2003/326* (2013.01)

(58) Field of Classification Search
CPC ..... H01H 3/40; H01H 3/26; H01H 3/38
USPC ..... 200/43.16
See application file for complete search history.

(56) References Cited

FOREIGN PATENT DOCUMENTS

| | | | | |
|---|---|---|---|---|
| CN | 106504935 | A | 3/2017 | |
| DE | 2751857 | C2 | 5/1979 | |
| DE | 8409940 | U1 | 7/1984 | |
| DE | 29811118 | U1 | 10/1998 | |
| DE | 10354594 | A1 | 6/2005 | |
| DE | 102011085851 | A1 | 5/2012 | |
| DE | 202013103040 | * | 10/2014 | ..... B62D 59/04 |

(Continued)

OTHER PUBLICATIONS

PCT International Search Report and Written Opinion of International Searching Authority dated Oct. 7, 2019 corresponding to PCT International Application No. PCT/EP2019/067655 filed Jul. 2, 2019.

*Primary Examiner* — Edwin A. Leon
*Assistant Examiner* — Iman Malakooti
(74) *Attorney, Agent, or Firm* — Laurence A. Greenberg; Werner H. Stemer; Ralph E. Locher

(57) ABSTRACT

A drive apparatus for an isolator switch includes a motor and a gear mechanism. The gear mechanism has a drive shaft which can be driven in two opposite directions of rotation by the motor and the gear mechanism has an output shaft. A load torque lock prevents transmission of a load torque which acts on the output shaft to the drive shaft in either direction of rotation. An isolator switch with a drive apparatus is also provided.

6 Claims, 4 Drawing Sheets

(56) References Cited

FOREIGN PATENT DOCUMENTS

| | | | |
|---|---|---|---|
| DE | 202013103040 | U1 | 10/2014 |
| DE | 202016101802 | U1 | 4/2016 |
| EP | 3106698 | A1 | 12/2016 |

* cited by examiner

ISOLATOR SWITCH AND DRIVE APPARATUS FOR AN ISOLATOR SWITCH

BACKGROUND OF THE INVENTION

Field of the Invention:

The invention relates to a drive apparatus for an isolator switch with a motor and a gear mechanism, and to an isolator switch with a drive apparatus of this type.

Isolator switches which are also called disconnectors are as a rule driven by way of a motor, via which the isolator switch can be driven via a gear mechanism in two switching directions for switching on and off. In the case of an unforeseen standstill of the motor, an isolator switch must not move in the instantaneous switching direction or in the opposite direction with respect to said switching direction, since damage or accidents might otherwise occur. For example, in the case of a pantograph disconnector driven by a motor, it has to be prevented that, in the case of a failure of the motor during a switching movement, the pantograph disconnector is accelerated in an unbraked manner in the switch-off direction by the action of gravity.

In order, in the case of a failure of a motor, to prevent a movement of an isolator switch which is driven by way of said motor, the gear mechanism can be, for example, of self-locking design. In particular, the use of a worm gear mechanism can achieve a situation where the motor can drive the isolator switch via the gear mechanism, but conversely the gear mechanism blocks an action of force which emanates from the isolator switch. Worm gear mechanisms do not always have a reliable self-locking action, however. Therefore, for example, two worm gear mechanism stages are arranged behind one another. Worm gear mechanisms are expensive, however, and, as is known, have a poor degree of efficiency.

SUMMARY OF THE INVENTION

The invention is based on the object of specifying a drive apparatus for an isolator switch with a motor and a gear mechanism, which drive apparatus is improved with regard to the operational reliability in the case of a failure of the motor.

According to the invention, said object is achieved by way of a drive apparatus with the features described below.

Advantageous refinements of the invention are the subject matter of the dependent claims.

A drive apparatus according to the invention for an isolator switch comprises a motor, a gear mechanism which has an output shaft and a drive shaft which can be driven by the motor in two opposite rotational directions, and a load torque lock which prevents a transmission of a load torque, which acts on the output shaft, to the drive shaft in either rotational direction.

Therefore, the invention provides a drive apparatus for an isolator switch, which drive apparatus has a load torque lock, in order to prevent a transmission of a load torque, which acts on the output shaft, to the drive shaft in either rotational direction. As a result, it is prevented for the two rotational directions that a load torque which acts on the output shaft brings about a switching movement in the case of a standstill of the motor, which switching movement can cause damage or accidents. In particular, the invention does not require any further complicated self-locking design of the gear mechanism in order to prevent switching movements of this type.

Refinements of the invention provide that the load torque lock is arranged on the drive shaft between the motor and the gear mechanism, or between the drive shaft and the output shaft in the gear mechanism, or on the output shaft downstream of the gear mechanism.

The abovementioned refinements of the invention utilize the fact that a load torque lock can be arranged at various positions upstream of, in, or downstream of the gear mechanism (in relation to the motor), and the arrangement of the load torque lock can therefore advantageously be adapted to the functional and structural properties of the isolator switch.

A further refinement of the invention provides that the gear mechanism is a spur gear mechanism.

The abovementioned refinement of the invention utilizes the fact that the use of a load torque lock makes, in particular, the configuration of the gear mechanism as a simple spur gear mechanism possible, since the gear mechanism does not have to have a self-locking function which prevents a switching movement in the case of a standstill of the motor. In comparison with self-locking gear mechanisms such as self-locking worm gear mechanisms, spur gear mechanisms have advantages with regard to the degree of efficiency, the costs, availability and ease of obtaining. Since spur gear mechanisms have parallel axles, they are of structurally simpler configuration than worm gear mechanisms which have axles which are perpendicular with respect to one another, and can therefore be produced more simply, with lower requirements of the manufacturing tolerances, and less expensively.

Further refinements of the invention provide that the load torque lock has wrap springs or clamping bodies or clamping rollers. In principle, a load torque lock of any design can be used for a drive apparatus according to the invention. In comparison with a load torque lock with clamping bodies or clamping rollers, a load torque lock with wrap springs can have the advantage that sliding backward of the clamping bodies or clamping rollers as a result of the stick-slip effect cannot occur, which sliding backward can lead to disruptive noise and wear.

An isolator switch according to the invention has a drive apparatus according to the invention. The advantages of an isolator switch according to the invention correspond to the advantages which have already been mentioned above of a drive apparatus according to the invention, and therefore will not be repeated again here.

The above-described properties, features and advantages of this invention and the way in which they are achieved will become clearer and more readily comprehensible in conjunction with the following description of exemplary embodiments which will be described in greater detail in conjunction with the drawings.

DETAILED DESCRIPTION OF THE INVENTION

Parts which correspond to one another are provided with the same designations in the figures.

Figure 1:
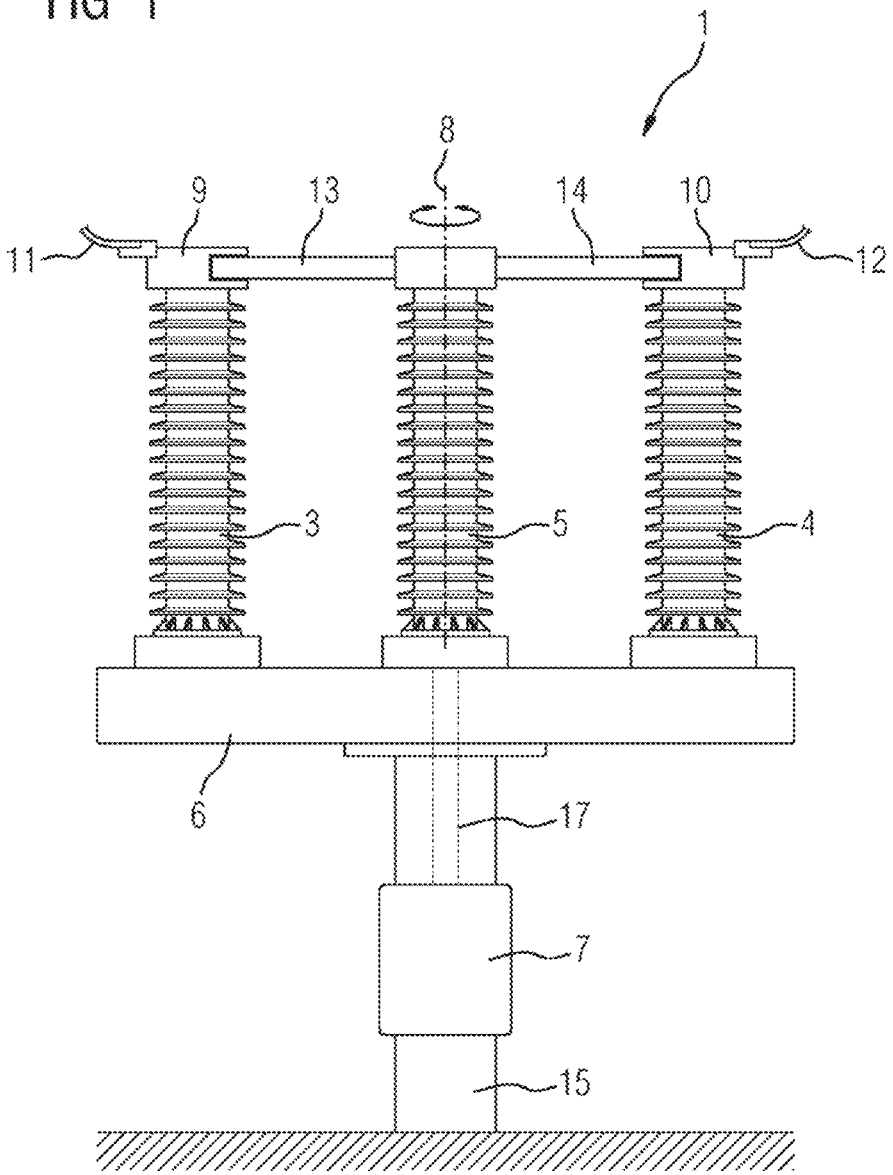
FIG. 1 shows one exemplary embodiment of an isolator switch.

FIG. 1 shows one exemplary embodiment of an isolator switch 1 in a side view. The isolator switch 1 is configured as what is known as a double-pivot disconnector and comprises two isolator columns 3, 4, a rotary isolator 5 and a drive apparatus 7 according to the invention. The rotary isolator 5 is arranged between the two isolator columns 3, 4, and is mounted such that it can be rotated about a rotational axis 8. The isolator columns 3, 4 and the rotary isolator 5 are arranged on a carrier 6.

At an upper end, each isolator column 3, 4 has a contact connector 9, 10 which is connected to a connector line 11, 12.

At an upper end, the rotary isolator 5 has two contact arms 13, 14. The rotary isolator 5 can be rotated about the rotational axis 8 between two switching positions. In a first switching position which is shown in FIG. 1, a first contact arm 13 makes contact with the contact connector 9 of a first isolator column 3 and the second contact arm 14 makes contact with the contact connector 10 of the second isolator column 4. In the second switching position, the two contact arms 13, 14 are disconnected from the contact connectors 9, 10 of the isolator columns 3, 4.

Figure 2:
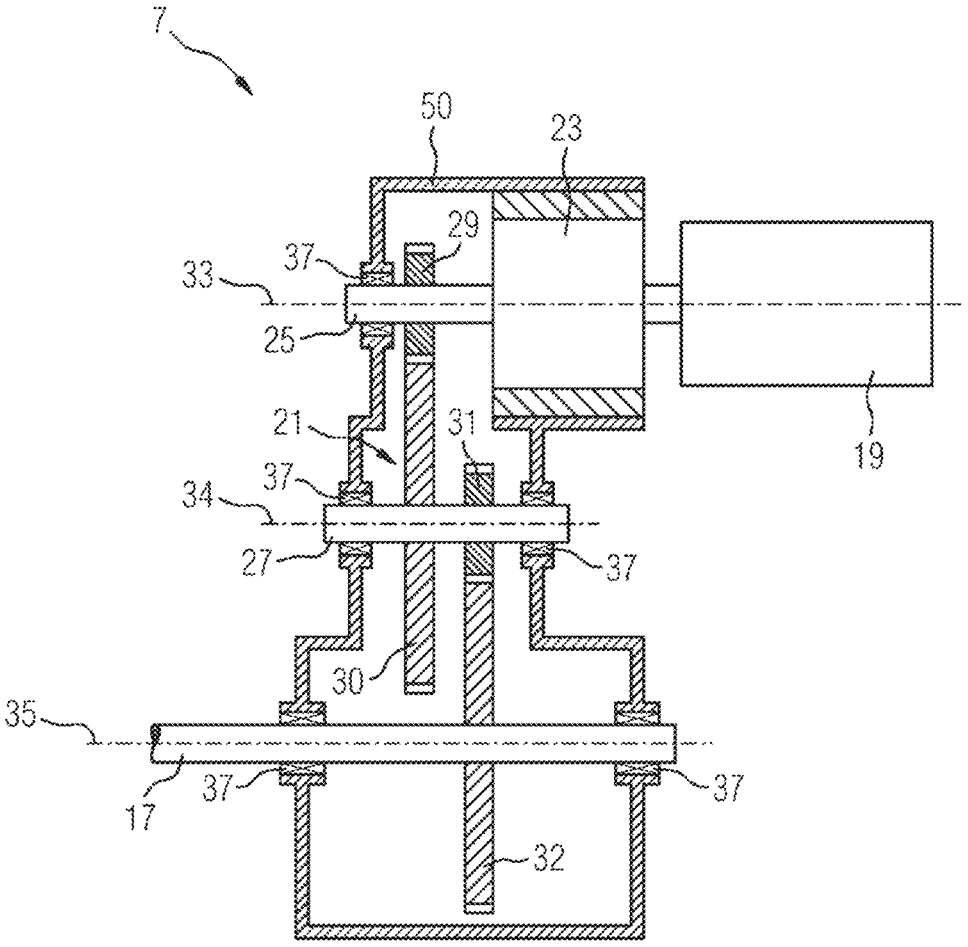
FIG. 2 shows a diagrammatic sectional illustration of a first exemplary embodiment of a drive apparatus for an isolator switch.
Figure 3:
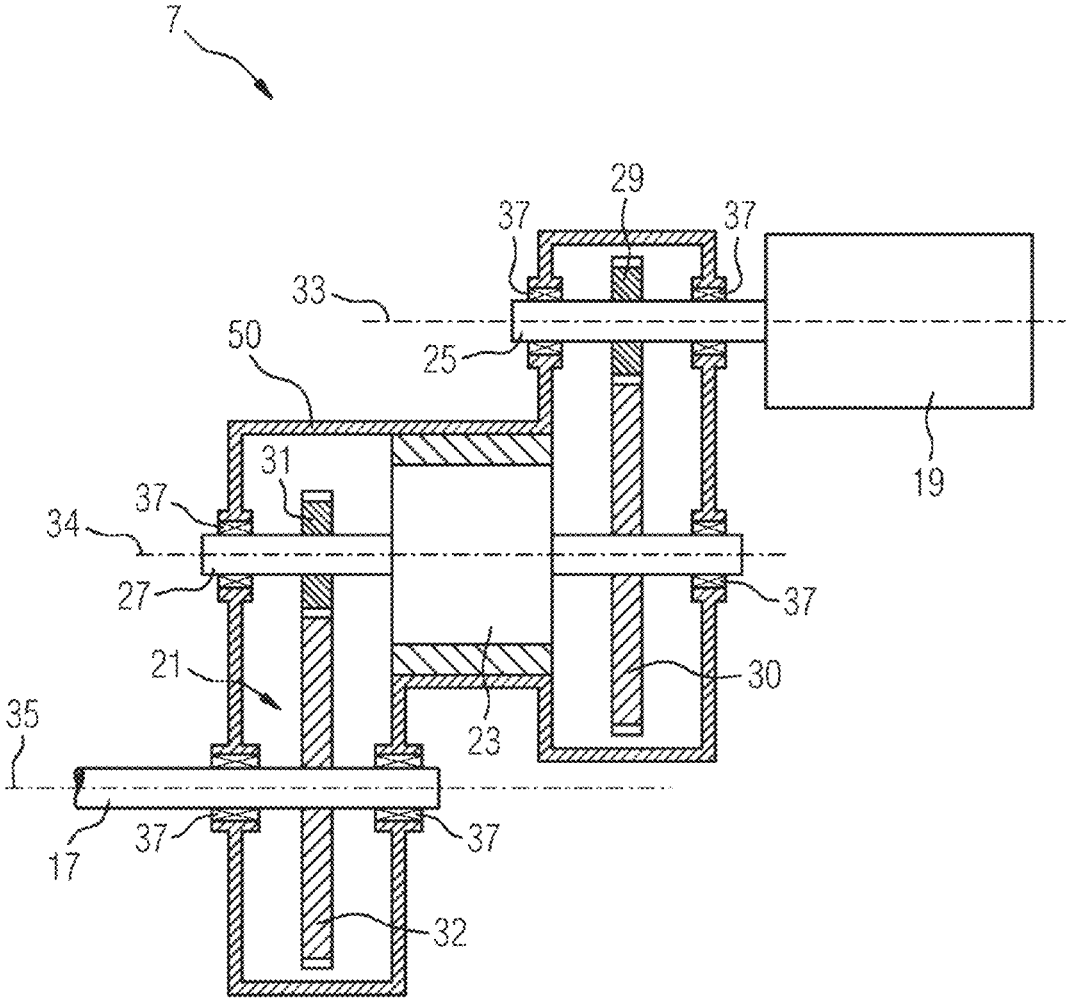
FIG. 3 shows a diagrammatic sectional illustration of a second exemplary embodiment of a drive apparatus for an isolator switch.
Figure 4:
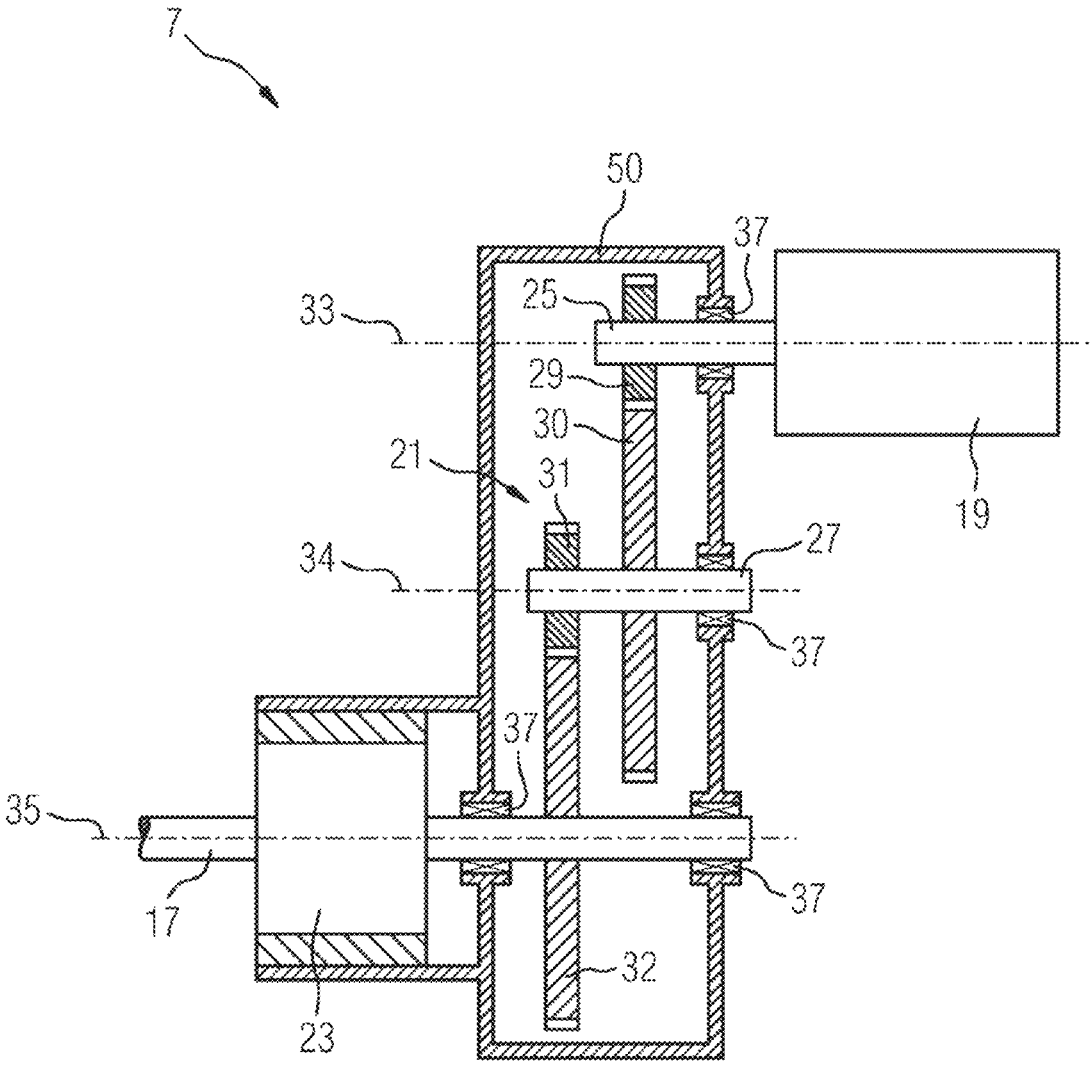
FIG. 4 shows a diagrammatic sectional illustration of a third exemplary embodiment of a drive apparatus for an isolator switch.

The drive apparatus 7 is arranged on a support 15 of the carrier 6 below the rotary isolator 5. The drive apparatus 7 has an output shaft 17 which is coupled to the rotary isolator 5 and via which the rotary isolator 5 can be rotated between its switching positions by way of the drive apparatus 7. FIGS. 2 to 4 show various exemplary embodiments of the drive apparatus 7.

FIG. 2 shows a first exemplary embodiment of the drive apparatus 7 in its diagrammatic sectional illustration. The drive apparatus 7 comprises a motor 19, a gear mechanism 21 and a load torque lock 23.

The motor 19 is configured as an electric motor.

The gear mechanism 21 is configured as a two-stage spur gear mechanism with the output shaft 17, a drive shaft 15, an intermediate shaft 27 and spur gears 29 to 32. A drive shaft axis 33 which is a longitudinal axis of the drive shaft 25, an intermediate shaft axis 34 which is a longitudinal axis of the intermediate shaft 27, and an output shaft axis 35 which is a longitudinal axis of the output shaft 17 are arranged parallel to one another.

A first spur gear 29 is connected rigidly to the drive shaft 25, a second spur gear 30 and a third spur gear 31 are connected rigidly to the intermediate shaft 27, and a fourth spur gear 32 is connected rigidly to the output shaft 17. The first spur gear 29 is coupled to the second spur gear 30. The third spur gear 31 is coupled to the fourth spur gear 32. The drive shaft 25, the intermediate shaft 27 and the output shaft 17 are mounted in bearings 37 such that they can be rotated about their respective longitudinal axis, which bearings 37 are arranged on a housing 50 of the gear mechanism 21.

The drive shaft 25 can be driven by the motor 19 in two opposed rotational directions about the drive shaft axis 33. The rotations of the drive shaft 25 can be transmitted via the intermediate shaft 27 and the spur gears 29 to 32 to the output shaft 17, with the result that the output shaft 17 is rotated in the same rotational direction as the drive shaft 25 by way of rotations of the drive shaft 25.

The load torque lock 23 is arranged on the drive shaft 25 between the motor 19 and the gear mechanism 21. The load torque lock 23 is configured to prevent a transmission in either rotational direction of a load torque, which acts on the output shaft 17, to the drive shaft 25. To this end, the load torque lock 23 has, for example, wrap springs, clamping bodies or clamping rollers. Load torque locks 23 of this type are already known from the prior art and will therefore not be described in greater detail here. For example, load torque locks 23 with wrap springs are disclosed in DE 102011085851 A1, load torque locks with clamping rollers are disclosed in DE 202016101802 U1, and load torque locks with clamping bodies of other forms are disclosed in EP 3106698 A1.

FIG. 3 shows a second exemplary embodiment of the drive apparatus 7 in a diagrammatic sectional illustration. Said exemplary embodiment of the drive apparatus 7 differs from the exemplary embodiment which is shown in FIG. 2 substantially only in that the load torque lock 23 is arranged on the intermediate shaft 27 in the gear mechanism 21, and in that the arrangement of the second spur gear 30 and the third spur gear 31 on the intermediate shaft 27 is swapped in comparison with the exemplary embodiment which is shown in FIG. 2.

FIG. 4 shows a third exemplary embodiment of the drive apparatus 7 in a diagrammatic sectional illustration. Said exemplary embodiment of the drive apparatus 7 differs from the exemplary embodiment which is shown in FIG. 2 substantially only in that the load torque lock 23 is arranged on the output shaft 17 downstream of the gear mechanism 21, the arrangement of the second spur gear 30 and the third spur gear 31 on the intermediate shaft 27 is swapped in comparison with the exemplary embodiment which is shown in FIG. 2, and the drive shaft 25 and the intermediate shaft 27 are mounted on the housing 50 only by way of in each case one bearing 37.

Although the invention has been described and illustrated in greater detail by way of preferred exemplary embodiments, the invention is not restricted by way of the disclosed examples, and other variations can be derived herefrom by a person skilled in the art, without departing from the scope of protection of the invention.

The invention claimed is:

1. A drive apparatus for an isolator switch, the drive apparatus comprising:

a motor;

a gear mechanism, said gear mechanism having a drive shaft to be driven by said motor in two opposite rotational directions, and said gear mechanism having an output shaft; and a load torque lock preventing a transmission of a load torque acting on said output shaft to said drive shaft in either rotational direction;

said load torque lock being disposed on said drive shaft between said motor and said gear mechanism or said load torque lock being disposed on said output shaft downstream of said gear mechanism.

2. The drive apparatus according to claim 1, wherein said gear mechanism is a spur gear mechanism.

3. The drive apparatus according to claim 1, wherein said load torque lock includes wrap springs.

4. The drive apparatus according to claim 1, wherein said load torque lock includes clamping bodies.

5. The drive apparatus according to claim 1, wherein said load torque lock includes clamping rollers.

6. An isolator switch, comprising a drive apparatus according to claim 1.

* * * * *